US007824079B2

(12) United States Patent
Cuppett et al.

(10) Patent No.: US 7,824,079 B2
(45) Date of Patent: Nov. 2, 2010

(54) LIGHT TOWER DIFFUSER

(75) Inventors: Jonathan Cuppett, Carson, CA (US); Mary Hidalgo, Costa Mesa, CA (US)

(73) Assignee: Multiquip, Inc., Carson, CA (US)

( * ) Notice: Subject to any disclaimer, the term of this patent is extended or adjusted under 35 U.S.C. 154(b) by 161 days.

(21) Appl. No.: 12/330,352

(22) Filed: Dec. 8, 2008

(65) Prior Publication Data

US 2010/0142209 A1 Jun. 10, 2010

(51) Int. Cl.
*F21V 11/00* (2006.01)

(52) U.S. Cl. ..... 362/355; 362/278; 362/285; 362/320; 362/352; 362/358; 362/403; 362/418; 362/431; 362/449; 362/450

(58) Field of Classification Search ..... 362/277–279, 362/285, 319–320, 351–352, 355–358, 403, 362/418, 431, 433–434, 449–451
See application file for complete search history.

(56) References Cited

U.S. PATENT DOCUMENTS

| | | | |
|---|---|---|---|
| 5,782,668 | A | 7/1998 | Chabert |
| 6,012,826 | A | 1/2000 | Chabert |
| 6,305,827 | B1 | 10/2001 | Nolle |
| 6,966,676 | B2 | 11/2005 | Chabert et al. |
| 7,246,913 | B2 | 7/2007 | Ossolinski |
| 7,252,414 | B2 | 8/2007 | Chabert |
| 7,264,382 | B2 | 9/2007 | Yoshimori et al. |

*Primary Examiner*—Jason Moon Han
(74) *Attorney, Agent, or Firm*—Frank J. Dykas; Scott D. Swanson; Dykas, Shaver & Nipper, LLP

(57) ABSTRACT

The invention provides a diffuser for a portable light tower that has an envelope of fire resistant material designed to diffuse light situated on a frame forming a generally spherical structure that can be opened and closed by use of a pulley and cable system.

17 Claims, 5 Drawing Sheets

LIGHT TOWER DIFFUSER

FIELD OF THE INVENTION

The invention relates generally to an apparatus for diffusing light emitted by a portable light emitting tower used to provide portable lighting.

BACKGROUND OF THE INVENTION

It is known to provide a portable light tower for emitting light along with an attached light diffuser. A portable light tower generally has a light emitter positioned in the upper end of an extendable and retractable supporting column vertically mounted on a power generator. The apparatus as a whole is commonly called a portable light tower. Additionally, diffusers for light emitters are also known. For example U.S. Pat. Nos. 6,305,827, 7,264,382, and 7,246,913 embody light diffusers that diffuse light from a portable light tower or portable lamp.

Portable light towers are available in a variety of sizes and emit a variety of light powers, depending on the operator's selection of a light tower as well as the operator's bulb selection for varying uses. In one species of portable light tower, the emitted light radiated from the lighting instrument is bright enough to allow a worker at a work site to easily perform work at night. However, although the lights provide sufficient light to work under, these lights are typically very bright and create problems when workers or others look up into the lights. This can be very hazardous to workers who are, for example but not limited to, operating a vehicle or working on scaffolding. When the workers look up into the bright light there exists a possibility that they can be temporarily blinded, crash a vehicle, or perform an action that leads to injury. Additionally, bright light towers can be a hazard to the public as well. For example, night working road construction crews often use light towers to illuminate their work areas. A motorist passing by the bright light of the light tower may be temporarily blinded or become fixated on the bright lights and fail to pay attention to the road or not be able to see the road. This creates a significant safety hazard to the motorist, the road construction crew, and any other person or object on the road.

Another problem with the bright, undiffused lights is that they create shadows on the work area. As workers are often required to work in a variety of positions, often times with their backs to the light tower, they create a variety of shadows that can severely inhibit their work productivity and lead to serious safety concerns. For example, a worker faces a difficult situation when he needs to perform a task but his only possible body position would be facing away from the light tower. Consequently, his body casts a dark shadow over the area where he is working and he runs a much higher risk of injury as he cannot adequately view the work area.

Glare can also present a problem in work environments. The bright light emitted by the light tower can glare off of reflective surfaces and interfere with work operations. An example is when glare from the light of a light tower is picked up by a camera and interferes with the scene recorded by the camera. Another situation that requires decreased glare is when a construction crew is working on a road at night.

A further problem is that as light towers are often very bright for illuminating large areas, large bulbs are used that can create copious amounts of heat. As current light diffusers do not use sufficient ventilation to allow air circulation, heat builds up in the light diffusers and can cause damage to the electrical equipment of the light tower or even cause the light diffuser to ignite. Additionally, this can make the equipment very difficult to maintain, to repair, or even to replace malfunctioning lights unless the tower is turned off and allowed to cool. In each of the situations work efficiency is significantly decreased as the full capabilities of the light tower are not utilized.

Another problem facing portable light towers and light diffusers is that often times the light diffuser does not have sufficient structure in order to prevent the light diffuser from coming into contact with the light. This can lead to a fire as the lights can be very hot and can ignite the light diffusing material of the light diffuser. Additionally, without an adequate underlying structure the light diffuser is expanded as long as air is forced into, or sealed within the diffuser envelope. If the light diffuser deflates, it can also come into contact with the often hot lights and ignite, or burn the diffuser material. Several attempts have been made to solve this problem. However, these attempts have not solved the problem as they still often use an air system with forced air to maintain an inflated balloon or an envelope that still uses a forced or sealed air supply to stay inflated. This requires an air pump or fan positioned to push air into the diffuser. Consequently, this requires an additional expenditure of energy to run the pump or fan making the light tower less efficient to operate.

In addition to the previous difficulties, current light towers also are not easily transportable when they are attached to a light diffuser or even when not attached to a light diffuser. In order to transport current light diffusers, they typically must be entirely removed from the light tower. When the light diffusers are removed from the light towers they are often very large and bulky making them awkward to transport alone as well as when attached to a light tower. Additionally, it is very difficult to remove the light diffusers from the light towers without completely disassembling the light tower diffuser. This leads to an increased amount of time spent assembling and disassembling the light diffusers. Consequently, the overall efficiency of the worksite decreases as it takes workers more time to assemble and disassemble the diffuser while other workers may have to wait additional time until they have adequate light in which to work.

The current state of light diffusers for portable light towers prevents the light diffuser and light tower from being easily transported. Light towers are typically transported by retracting the telescoping pole and folding the pole forward towards the tongue of the trailer. When a large light diffuser is left fully assembled to the telescoping tower, it is very difficult to transport because the light diffuser is very bulky. Furthermore, when the light diffuser is fully assembled on the light tower while in transit, the light diffuser presents a significant amount of wind resistance as it is big and bulky. In this situation, the light diffuser is much more prone to damage from flying debris, inclement weather, and acts of vandalism if it is left fully attached to the portable light tower while in transit.

For example, U.S. Pat. No. 7,264,382 to Yoshimori et al., to a light diffuser, provides a light emitting apparatus supported by a rigid, extendable frame. The rigid frame provides a support system with upward running extendable bars that support the light emitter as well as an air intake which provides suction to intake air in order to keep a balloon or envelope for diffusing light fully inflated. The balloon or envelope is attached via an attachment to the light supporting frame at the top and bottom of the frame. The apparatus apparently does not include a complete frame for supporting the balloon or envelope, rather it apparently provides a rigid frame for supporting a light emitter and the balloon attaches at the top and at the bottom of the frame. Accordingly, the rigid frame is not flexible nor does it appear to provide a support structure for the balloon or envelope which is likely supported by air sucked in through the intake. Additionally, the frame apparently does not provide a means for quickly closing or opening the light diffuser.

Another patent to a light diffuser, U.S. Pat. No. 7,246,913 to Ossolinski, apparently discloses a lighting apparatus with a frame and an envelope that is formed from two sheets of acrylic formed into dome shapes in order to slow deflation rate. Although the diffuser on this light tower apparently does not require an air supply, it apparently does establish that a preferred method to operate the light diffuser may be with an air supply being pumped into or sucked into the diffuser balloon. As the balloon likely relies on an air supply creating pressure within the balloon to remain inflated, it may not provide sufficient openings in order to allow air circulation for cooling the lights. Additionally, these balloons appear to require a near constant air flow into the balloon to remain inflated. This likely requires a near constantly operating air pump. In addition to the aforementioned problems, it appears that of the diffusers known in the art apparently no diffuser presents an easily disassembled or easily deployed light diffuser.

Accordingly an object of the invention is to provide a system for quickly disassembling the light diffuser for storage or periods of non use and quickly deploying the system for operation.

Accordingly, a further object of the present invention is to provide a circulation opening on the top of the light diffuser and an opening on the bottom of the light diffuser for increased air circulation.

A third object of the invention is to provide a system for easily disassembling and strapping down the light diffuser for transport of the portable light tower.

A fourth object of the invention is to provide a diffuser on a light tower that does not create a significant amount of glare, shadows, or temporary blindness if someone looks into the light.

A fifth object of the invention is to provide a diffuser that is for use with any manufacturer's light tower.

SUMMARY OF THE INVENTION

The present invention provides a light diffuser for universal use on portable light towers of any manufacturer's construction that involves increased air circulation, increased storage capability, increased assembly capabilities, increased transportation capabilities, reduced creation of glare and shadows, and decreased danger of workers and others becoming imperiled due to looking at the bright lights of the light tower. An example of a portable light tower is shown in FIG. 1, with the present light diffuser invention attached.

The invention provides an envelope for diffusion of light from a portable light tower, a new frame and deployment mechanism to improve the deployment capabilities and retraction capabilities of a light diffuser, and several openings for air circulation on the top and bottom of the light diffuser to prevent heat build up. The frame prevents a balloon or envelope for light diffusion from coming into contact with the hot lights of an operating light tower and igniting or burning the diffuser material. The frame includes a plurality of flexible rods removably attached between an upper bracket and a lower ring for supporting an envelope of fire resistant material designed to diffuse light generated by a light tower. Additionally, the flexible rods have one way hinges to allow the frame pieces to be folded to enhance storage and transportation capabilities. The frame and envelope are mounted on an attachment pole that has a cable and pulley system attached for opening and closing the envelope frame. The cable and pulley system significantly enhances the light diffuser as it provides an easy way to deploy and close the frame system of the diffuser. The attachment pole in turn is attached to an extendable mast that supports a light emitting system.

When the operator wishes to transport the light tower, he can retract the extendable light tower support pole, remove the envelope from the light diffuser, and subsequently collapse the frame of the light diffuser by pulling on a cable of the cable and pulley system that lowers the lower ring and consequently straightens the frame members. The frame members can then be strapped down to the extendable light tower support mast, the mast can be folded away from the tongue of the portable light tower trailer, and the portable light tower can subsequently be moved to the next location or job site. This provides a new and improved way of quickly assembling, disassembling, and transporting the light diffuser.

In addition to the aforementioned benefits of the portable light tower and new light diffuser, the light diffuser also provides openings at the top and bottom of the light tower frame and envelope for increased air circulation capabilities in order to prevent heat buildup in the light diffuser. This prevents excess heat buildup from causing the light diffuser to ignite, burn, or other wise damage any of the parts of the light diffuser or the portable light tower.

The purpose of the foregoing Summary is to enable the public, and especially the scientists, engineers, and practitioners in the art who are not familiar with patent or legal terms or phraseology, to determine quickly from a cursory inspection, the nature and essence of the technical disclosure of the application. The Summary is neither intended to define the invention of the application, which is measured by the claims, nor is it intended to be limiting as to the scope of the invention in any way.

DESCRIPTION OF PREFERRED EMBODIMENTS

The following is a detailed description of the preferred embodiments referencing the drawings.

Figure 1:
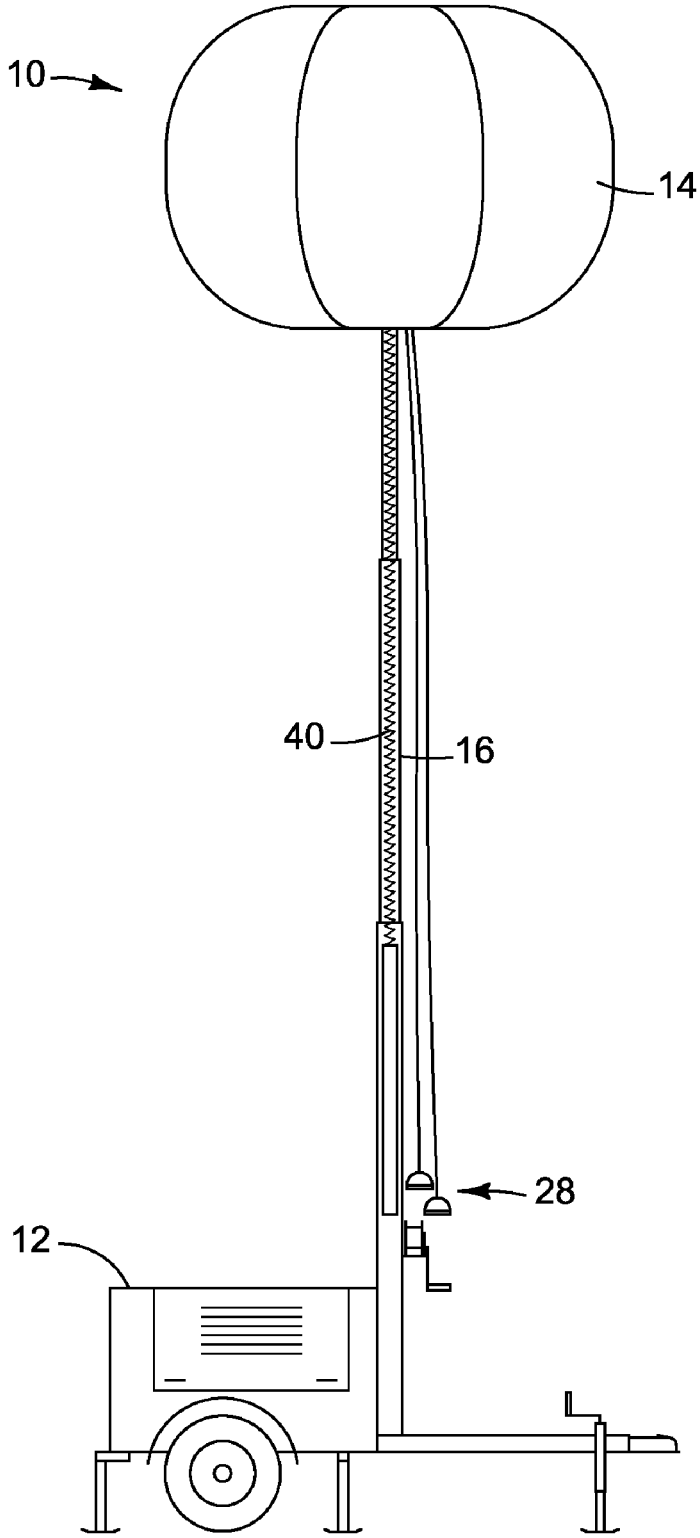
FIG. 1 illustrates the portable light diffuser for use on a portable light tower attached to a light tower.

FIG. 1 illustrates a light tower 12 that utilizes floodlights or similar lights with an attached deployed light diffuser 10. Additionally, the light diffuser envelope 14, which can be an envelope, balloon, or similar structure, is attached to the light diffuser 10 which is attached to an extendable support mast 16 that is a part of the light tower system 12. Although the envelope 14 can be made from a variety of materials, these materials include but are not limited to, Mylar, plastic, cloth, or other synthetic material fabric enabling the diffusion of light from the light tower lights. In a preferred embodiment, the envelope 14 is made of a fire resistant material.

As illustrated, the light tower system 12 when attached to the light diffuser 10 has a cable and pulley system 28 for quickly deploying or collapsing the light diffuser 10. Also as illustrated from the drawing, in the preferred embodiment the light diffuser envelope 14 is generally formed in a spherical or ellipsoidal shape to evenly diffuse light. The light diffuser 10 sits on top of a light tower support bar which also supports an electrical wire 40 for powering the lights 34 of the light tower 12.

Figure 2:
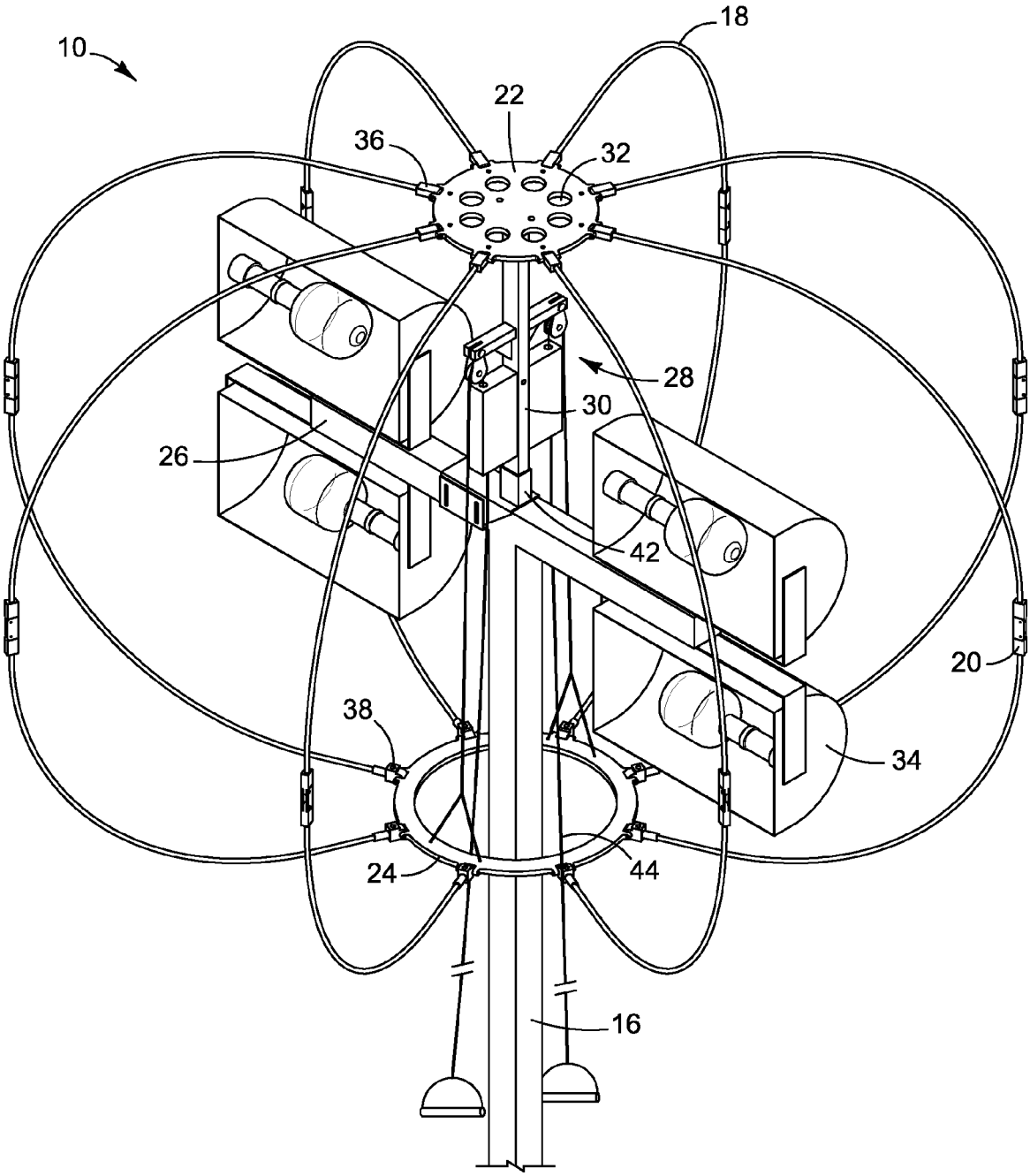
FIG. 2 illustrates the portable light diffuser without an attached envelope attached to a portable light tower for illustration of the interior aspects of the light diffuser.

FIG. 2 illustrates the light diffuser 10 attached to a light tower 12. The view illustrates the light diffuser 10 without a light diffuser envelope 14. In a preferred embodiment, the light diffuser 10 has a upper bracket 22 and a lower ring 24 with a plurality of flexible rods 18 interconnecting the upper bracket 22 and the lower ring 24. The flexible rods 18 are typically removably connected to the upper bracket 22 and the lower ring 24 by connectors 36 and 38. The flexible rods 18 can be made of metal, fiberglass, carbon fiber, or other composite material or flexible material. The upper bracket 22 and the lower ring 24 can be made from plastic, fiberglass, carbon fiber, or other composite material or similar material. The upper bracket 22 is attached to an attachment pole 30 which is removably connected to a T-bar support 26 or similar support of any manufacturer's portable light tower 12 at attachment point 42. This assembly supports the envelope 14 for diffusing light of the light tower 12. In a preferred embodiment, the plurality of flexible rods 18 each has a one way hinge 20 for increased deployment capability for operation and increased collapsing capability for periods of non use or storage. The hinge 20 creates a pivot point for the flexible rods 18 to bend at to provide a break down point at which each rod 18 can be folded for increased storage and transportation capability by making each flexible rod 18 into a more compact and easy to carry form. The light diffuser system 10 is attached via an attachment pole 30 attached to the T-bar, crossbar, or similar light support 26. In a preferred embodiment the light diffuser 10 and envelope 14 also have openings 32 at the top and openings 44 at the bottom for increased air circulation to prevent heat buildup.

A system of cables and pulleys 28 connects to the attachment pole 30 and enables the structure to be deployed, or opened, for operation or collapsed for transportation or periods of non use. In a preferred embodiment, a light tower operator deploys and closes the light diffuser 10 by pulling on the first cable or the second cable of the cable and pulley system 28 that in turn raises or lowers the lower ring 24 of the light diffuser 10 toward and away from the upper bracket 22. The cable and pulley system 28 serves as a means to raise and lower the lower ring 24 of the light diffuser 10. Additionally, further means for raising and lowering the lower ring 24 of the light diffuser 10 can include a system similar to a mechanical jack or an electrical lift to raise and lower the lower ring 24 of the light diffuser 10. When the operator pulls on the cable to deploy the light diffuser 10, the cable and pulley system 28 raises the lower ring 24 and causes the flexible rods 18 to flex outwards until the rods 18 reach the desired spherical or ellipsoidal shape for even light diffusion, at which point the lower ring 24 is not moved any further and can be locked into place, thus preventing the flexible rods 18 from additional flexing or from pushing the lower ring 24 down. Two examples of systems preventing the lower ring 24 from moving or to lock the lower ring 24 include, but are not limited to, providing a locking mechanism or by providing a cable and pulley system 28 that will not allow the cable and pulley system 28 and lower ring 24 to move without application of force greater than the force exerted by the flexed rods 18 pushing against the lower ring 24. In addition to the pulley and cable system 28, several other systems can be used as well and modifications can be made to the pulley and cable system 28. For example, the pulley and cable system 28 can include a winch that when started can either raise or lower the lower ring 24 by pulling the cable or releasing the cable of the cable and pulley system 28.

In a preferred embodiment, in order to attach or detach the light diffuser 10 the operator lowers the extendable mast 16 of the light tower in order to attach or detach the envelope 14 to the light diffuser assembly 10, to transport the light tower assembly 12, store the light tower assembly 12, or perform maintenance on the light tower assembly 12. If the light tower 12 is being used without a diffuser and the flexible rods 18 are secured to the light tower mast 16, the operator can easily lower the mast 16, and attach the envelope 14 to the light diffuser 10, and deploy the light diffuser 10. In order to close the light diffuser 10, the operator must retract the extendable mast 16, remove the envelope 14, and subsequently pull the cable and pulley system 28 to lower the lower ring 24 of the light diffuser thus extending the plurality of flexible rods 18 to a straight, as opposed to flexed, position. Additionally, in a preferred embodiment the plurality of flexible rods 18 are arranged such that when the rods 18 are straightened in a closed position, the rods 18 fit around the light emitters 34 such that the rods lay generally flat and parallel to the telescoping support arm 16. At this point the rods 18 can be secured to the portable light tower 12 for transport or periods of non use of the light diffuser 10. The light diffuser assembly 10 can be left attached to the light tower 12 when closed or it can be easily removed from the light tower 12 for periods of extended non use.

Figure 3:
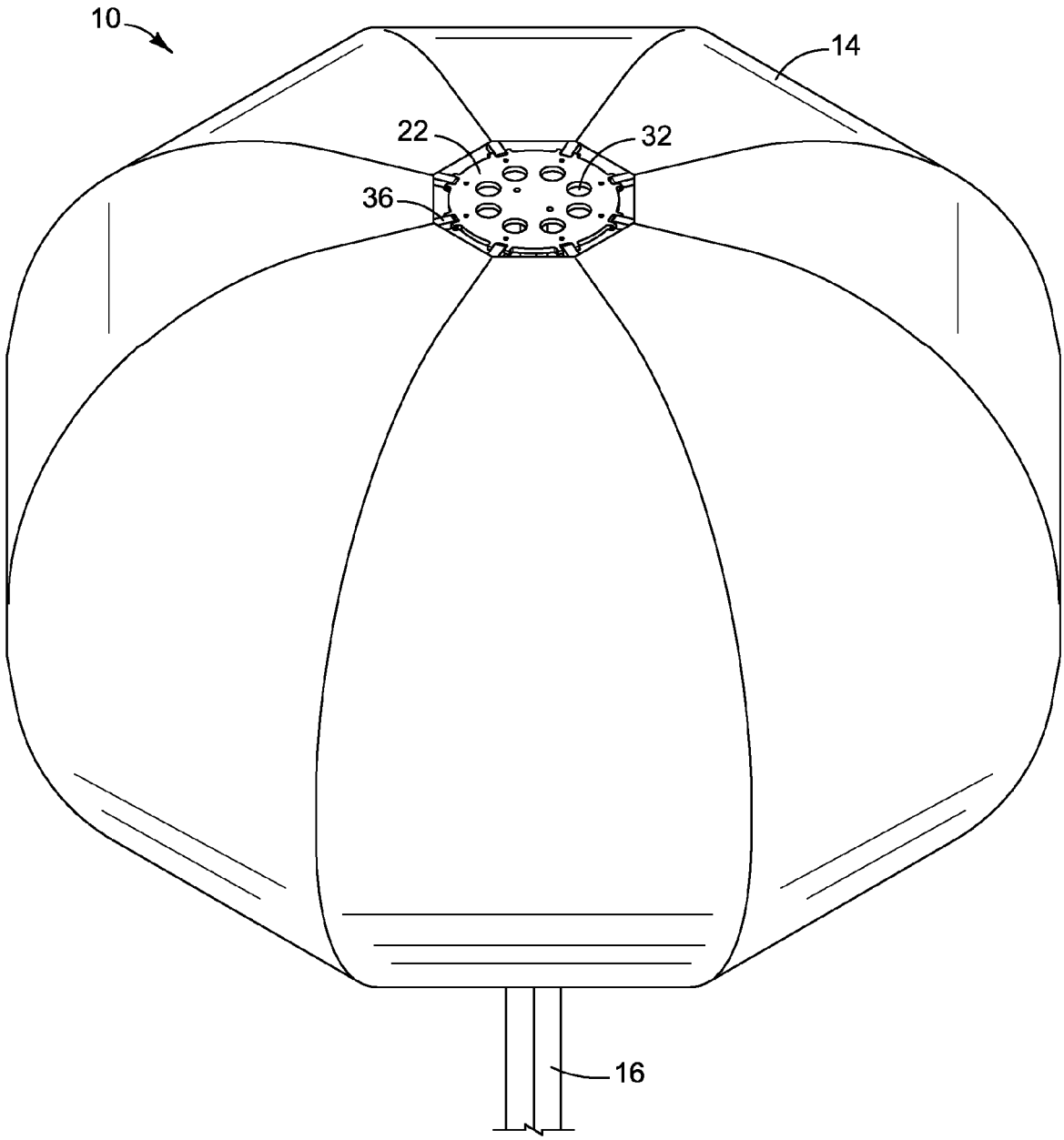
FIG. 3 illustrates a portable light diffuser with an attached envelope for use with a portable light tower.

FIG. 3 illustrates the light diffuser 10 with the light diffuser envelope 14 attached to the light diffuser 10. The light tower envelope 14 has holes at the top 32 of the envelope 14 as well as holes in the upper bracket 22 of the frame of the light diffuser 10 for ventilation. The light diffuser 10 is attached to the light tower extendable mast 16 for support while encapsulating the lighting system 34 of the light tower 12. The light tower mast 16 typically is an extendable telescoping bar as is known to be used on typical portable light towers 12.

Figure 4:
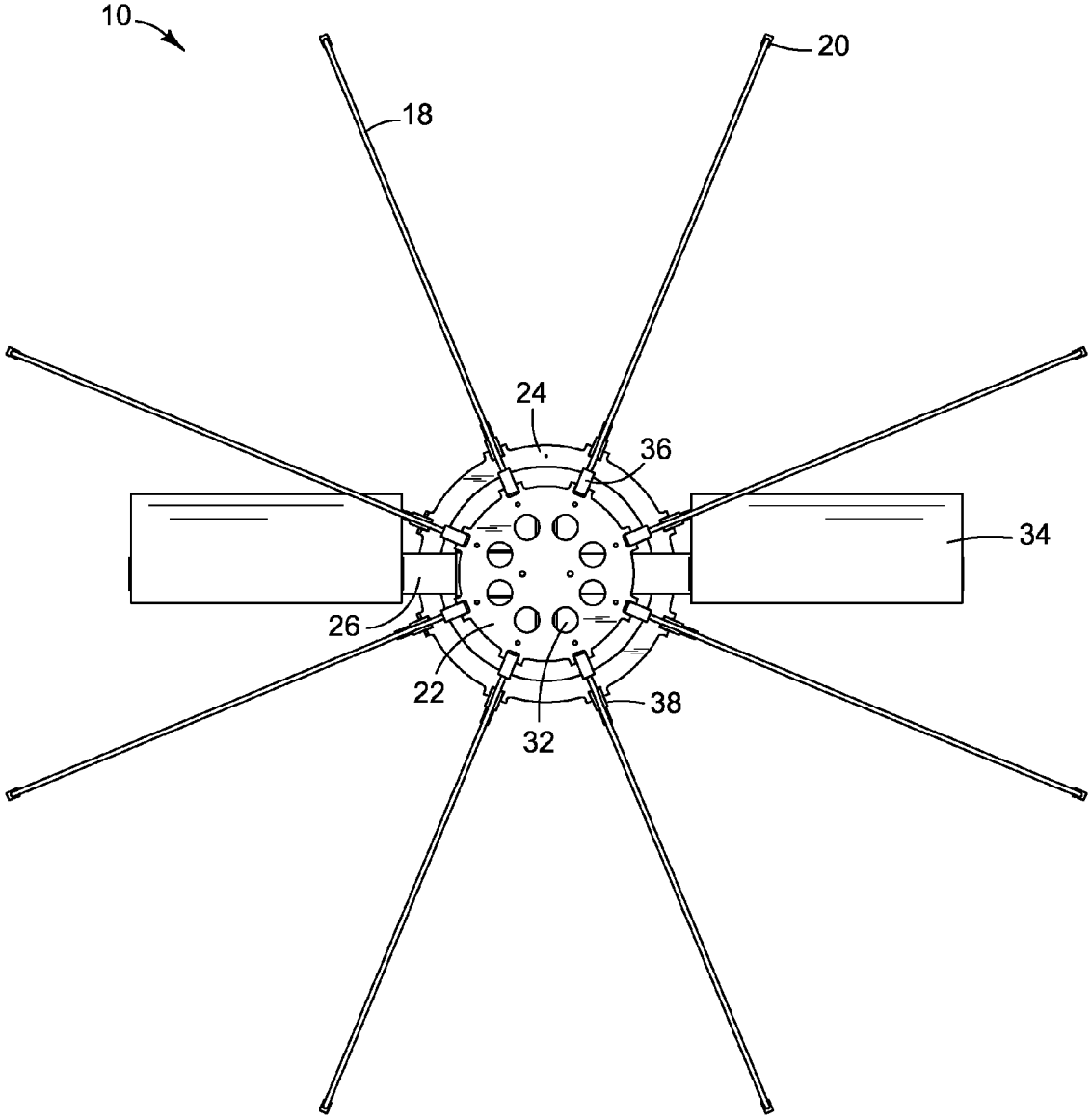
FIG. 4 is a top view of a portable light diffuser without an attached envelope attached to a portable light tower for illustration of the interior aspects of the light diffuser.

FIG. 4 illustrates the light diffuser 10 viewed looking down from the top of the light diffuser 10 without the light tower envelope 14 attached to the light diffuser 10. As FIG. 4 illustrates, the flexible rods 18 are attached to the upper bracket 22 via connection 36. In the ideal embodiment, the flexible rods 18 are releasable from the upper bracket 22 via releasable connections 36. The one way hinges 20 allow the portable light diffuser 10 to be easily deployed for operation or collapsed for packaging or storing. FIG. 4 also illustrates the T-bar 26 or crossbar support system that supports the light mechanisms 34 of the light tower 12. As illustrated the plurality of flexible rod assemblies 18 connect to the upper bracket 22 at connection 36 as well as to the lower ring at connection 38. In a preferred embodiment the connections 36 are easily attached and detached for quick assembly and disassembly of the light diffuser 10. In a preferred embodiment there are openings 32 in the upper bracket 22 and openings 44 at the lower ring 24 to allow for air circulation in order to decrease heat build up within the envelope 14.

Figure 5:
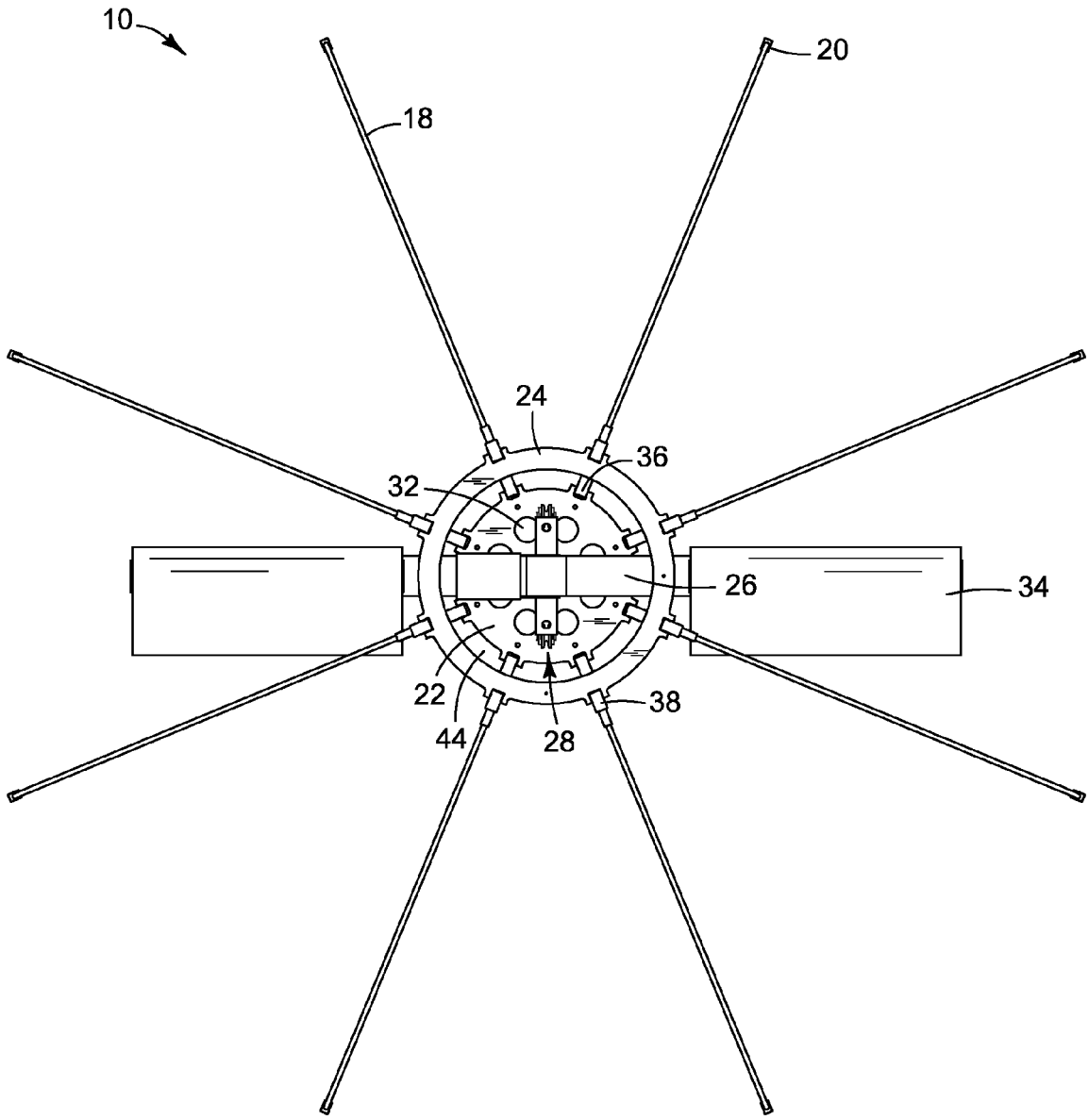
FIG. 5 is a bottom view of a portable light diffuser without an attached envelope for use with a portable light tower for illustration of the interior aspects of the light diffuser.

FIG. 5 illustrates the view from the bottom of the light diffuser 10 looking up through the assembly without an envelope 14 attached to the light diffuser 10. The view further illustrates the plurality of flexible rods 18 have a hinge 20 and are attached to the lower ring 24 via an attachment 38. As previously described, in the preferred embodiment the hinge 20 is a one way hinge 20 constructed to be flexible and easily folded for quick removal and setup. Also as previously described the light tower mast 16 has a pulley and cable system 28 and is attached to the T-bar support 26, crossbar support, or similar support system of a portable light tower 12, which supports the lighting system 34 of the light tower 12. The light diffuser 10 is constructed to fit any manufacturer's light tower as the light tower mast 16 is configured to connect directly to the T-bar support 26, crossbar support, or similar support system of a portable light tower 12. This connection can be made by a series of pins and attachment holes for inserting the pins, clamps, or any other connection method. As previously illustrated and described, the upper bracket 22 and lower ring 24 have holes 32, 44 to allow for ventilation and air circulation.

In the preceding description and in the figures, like elements are identified with like reference numerals. The use of "or" indicates a non-exclusive alternative without limitation unless otherwise noted.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

What is claimed is:

1. A light diffuser for use with a light tower equipped with a T-bar, crossbar or similar light support, comprising:

an upper bracket, wherein said upper bracket lies in a generally horizontal plane;

a lower ring, wherein said lower ring lies in a plane generally parallel to said upper bracket, wherein said lower ring and said upper bracket are generally positioned such that said upper bracket is above said lower ring such that said upper bracket and said lower ring have a central axis plane running generally through the center of said upper bracket and generally through the center of said lower ring;

wherein said upper bracket is positioned above said T-bar, crossbar or similar light support of said light tower and said lower ring is positioned below said T-bar, crossbar or similar light support of said light tower;

a means for moving said upper bracket and said lower ring closer together and further apart;

a plurality of flexible rod assemblies connecting said upper bracket and said lower ring, said plurality of flexible rod assemblies forming a support structure between said upper bracket and said lower ring, said support structure expandably configured such that when said lower ring and said upper bracket are in a farther apart position, said flexible rod assemblies are in a generally straight position, when said lower ring and said upper bracket are moved closer together, said flexible rod assemblies flex outward to form a generally spherical or generally ellipsoidal shaped frame, said flexible rods assemblies positioned such that when said lower ring is moved away from said upper bracket, said rod assemblies straighten around said support T-bar, crossbar, or similar light structure such that said support T-bar, crossbar, or similar light structure does not interfere with said straightening of said rods; and an envelope of light diffusing material removably attached to said upper bracket and said lower ring and encapsulating said plurality of flexible rod assemblies, said envelope supported by said plurality of flexible rod assemblies, said plurality of flexible rod assemblies and said envelope forming a generally spherical or generally ellipsoidal light diffuser when said lower ring is moved towards said upper bracket.

2. The light diffuser of claim 1 wherein said envelope further comprises at least two openings configured for air circulation on said envelope, said openings being on generally opposite sides of said envelope.

3. The light diffuser of claim 1 wherein each of said plurality of flexible rod assemblies connecting said upper bracket and said lower ring further comprises at least one hinge per flexible rod assembly.

4. The light tower diffuser of claim 3 wherein at least one of said hinges further comprises a one way hinge.

5. The light diffuser of claim 3 wherein said envelope further comprises at least two openings configured for air circulation on said envelope, said openings being on generally opposite sides of said envelope.

6. The light diffuser of claim 1 wherein said means for moving said upper bracket and said lower ring closer together and further apart further comprises a pulley and cable system operatively connected to said lower ring, wherein said pulley and cable assembly is configured and positioned to move said lower ring closer to said upper bracket and further from said upper bracket by raising and lowering said lower ring.

7. The light diffuser of claim 6 wherein said envelope further comprises at least two openings configured for air circulation on said envelope, said openings being on generally opposite sides of said envelope.

8. The light diffuser of claim 6 wherein at least one of said plurality of flexible rod assemblies connecting said upper bracket and said lower ring further comprises at least one hinge.

9. The light diffuser of claim 8 wherein at least one of said hinges further comprises a one way hinge.

10. The light diffuser of claim 8 wherein said envelope further comprises at least two openings configured for air circulation on said envelope, said openings being on generally opposite sides of said envelope.

11. A light diffuser for use with a light tower equipped with a T-bar, crossbar or similar light support, comprising:

an upper bracket, wherein said upper bracket lies in a generally horizontal plane;

a lower ring generally parallel to said upper bracket, wherein said lower ring lies in a plane generally parallel to said upper bracket, wherein said lower ring and said upper bracket are generally positioned such that said upper bracket is above said lower ring such that said upper bracket and said lower ring have a generally vertical central axis plane running generally through the center of said upper bracket and generally through the center of said lower ring;

wherein said upper bracket is positioned above said T-bar, crossbar or similar light support of said light tower and said lower ring is positioned below said T-bar, crossbar or similar light support of said light tower;

a plurality of flexible rod assemblies connecting said upper bracket and said lower ring, said plurality of flexible rod assemblies forming a support structure between said upper bracket and said lower ring, said support structure expandably configured such that when said lower ring and said upper bracket are at a furthest apart position, said flexible rod assemblies are in a generally straight position, and when said lower ring and said upper bracket are moved closer together, said flexible rod assemblies flex outward to form a generally spherical or generally ellipsoidal shaped frame, when the lower ring is lowered said rod assemblies straighten around said support T-bar, crossbar, or similar light structure such that said support T-bar, crossbar, or similar light structure does not interfere with said straightening of said rods;

an envelope of light diffusing material removably fastened to said upper bracket and said lower ring and encapsulating said plurality of flexible rod assemblies, said envelope supported by said plurality of flexible rod assemblies, said plurality of flexible rod assemblies and said envelope forming a generally spherical or ellipsoidal light diffuser when said lower ring is moved closer to said upper bracket; and a pulley and cable assembly operatively connected to said lower ring, wherein said pulley and cable assembly is configured and positioned to move said lower ring closer to said upper bracket and further from said upper bracket by raising and lowering said lower ring.

12. The light diffuser as in claim 11 wherein said light diffuser envelope further comprises at least two openings configured for air circulation on said envelope.

13. The light diffuser as in claim 12 wherein said at least two openings on said envelope further comprise being located on generally opposing locations on said envelope.

14. The light diffuser of claim 11 wherein said plurality of rods further comprises at least one hinge on at least one of said rods.

15. The light diffuser of claim 14 wherein at least one of said hinges further comprises a one way hinge.

16. The light diffuser of claim 11 wherein said light diffusing material further comprises a fire resistant material.

17. A light diffuser for use with a light tower equipped with a T-bar, crossbar or similar light support, comprising:

an upper bracket, wherein said upper bracket lies in a generally horizontal plane;

a lower ring generally parallel to said upper bracket, said lower ring positioned below said upper bracket such that the center of said upper bracket is positioned generally above said lower ring such that said center of said upper bracket and said center of said lower ring lay on generally the same vertical axis plane;

wherein said upper bracket is positioned above said T-bar, crossbar or similar light support of said light tower and said lower ring is positioned below said T-bar, crossbar or similar light support of said light tower;

a pulley and cable assembly connected to said lower ring and configured and located such that said pulley and cable assembly raises said lower ring when an operator pulls on a cable and lowers said lower ring when an operator pulls on a second cable to bring said lower ring closer and further from said upper bracket;

a plurality of flexible rod assemblies connecting said upper bracket and said lower ring, said plurality of flexible rod assemblies forming a support structure between said upper bracket and said lower ring, said support structure expandably configured such that when said lower ring and said upper bracket are at a furthest apart position, said flexible rod assemblies are in a generally straight position and limit the distance apart the upper bracket and lower ring can be from each other, and when said lower ring and said upper bracket are moved closer together, said flexible rod assemblies flex outward to form a generally spherical or generally ellipsoidal shaped frame, said flexible rods assembled such that when said support structure is contracted, said support T-bar, crossbar, or similar light structure does not interfere with said rods;

a one way hinge located on each of said rod assemblies in said series of rod assemblies; and an envelope generally spherical in shape with an opening at the top and an opening at the bottom of said envelope, said openings configured to allow air circulation, said envelope removably fastened to said upper bracket and said lower ring and said support structure supports said envelope, wherein said envelope is configured to evenly diffuse light from a light emitting tower and constructed of a fire resistant material.

* * * * *